United States Patent [19]

Wiik

[11] 4,160,133

[45] Jul. 3, 1979

[54] MOVING VOICE COIL LOUDSPEAKER WITH MAGNETIC DAMPING INCREASING AT LARGE EXCURSIONS

[76] Inventor: Tore H. Wiik, Verlegt. 46, N-1500 Moss, Norway

[21] Appl. No.: 882,464

[22] Filed: Mar. 1, 1978

[30] Foreign Application Priority Data

Mar. 1, 1977 [NO] Norway ..... 770687
Aug. 16, 1977 [NO] Norway ..... 772855

[51] Int. Cl.[2] ..... H04R 9/02; H04R 9/06
[52] U.S. Cl. ..... 179/115.5 VC; 179/180
[58] Field of Search ..... 179/115.5 VC, 115.5 DV, 179/115.5 R, 180

[56] References Cited

U.S. PATENT DOCUMENTS

| | | | |
|---|---|---|---|
| 1,767,837 | 6/1930 | Davis et al. | 179/115.5 VC |
| 2,269,284 | 1/1942 | Olson | 179/115.5 DV |
| 2,489,862 | 11/1949 | Cook | 179/115.5 VC |
| 2,556,816 | 6/1951 | Lukacs | 179/115.5 VC |
| 2,769,942 | 11/1956 | Hassan | 179/115.5 VC |

FOREIGN PATENT DOCUMENTS

| | | | |
|---|---|---|---|
| 1512727 | 5/1969 | Fed. Rep. of Germany | 179/115.5 VC |
| 864516 | 4/1941 | France | 179/115.5 VC |
| 478457 | 4/1976 | U.S.S.R. | 179/115.5 VC |

OTHER PUBLICATIONS

*IBM Technical Disclosure Bulletin,* vol. 19, No. 10, Mar. 1977, Bastianelli et al., "Linearization of an Edge--Wound Voice Coil Motor".

*Primary Examiner*—George G. Stellar
*Attorney, Agent, or Firm*—Sughrue, Rothwell, Mion, Zinn and Macpeak

[57] ABSTRACT

There is provided an electrodynamical loudspeaker comprising a voice coil fixed to a diaphragm and resiliently suspended for oscillation in the air gap of a magnet system, and wherein a short-circuit ring is provided at at least one end of the voice coil. The or each short-circuit ring may consist of solid, electrically conducting material or it may consist of a number of turns of electrically conducting material and with short-circuited end points.

5 Claims, 7 Drawing Figures

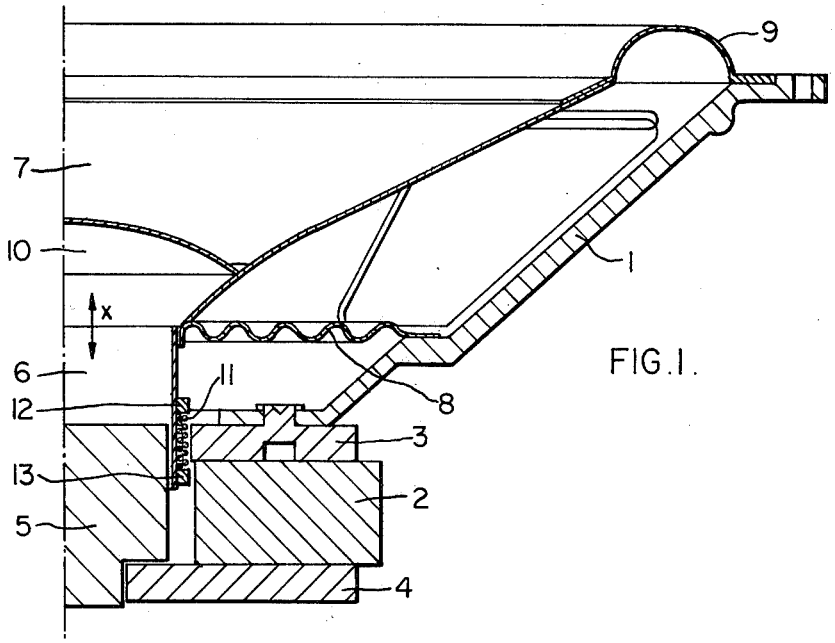
FIG. 1.
FIG. 2.
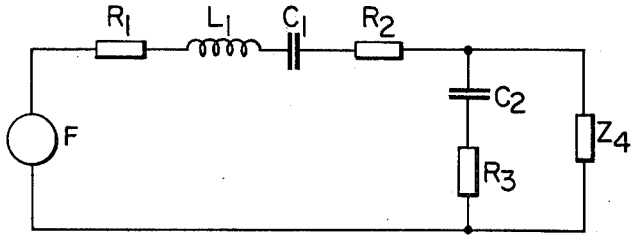
FIG. 3.
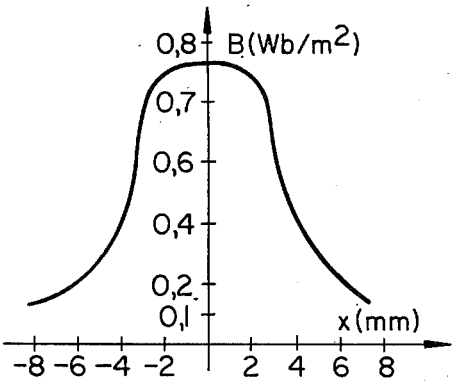
FIG. 4.
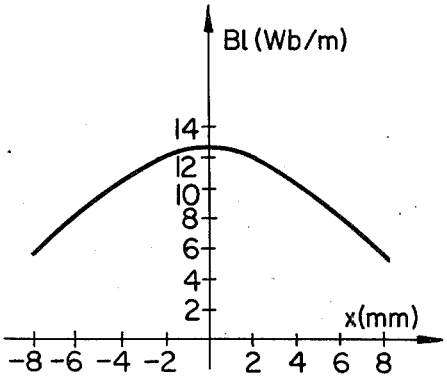

MOVING VOICE COIL LOUDSPEAKER WITH MAGNETIC DAMPING INCREASING AT LARGE EXCURSIONS

The present invention relates to an arrangement in an electrodynamical loudspeaker comprising a voice coil fixed to diaphragm and resiliently suspended for oscillation in the air gap of a magnet system.

In an electrodynamical loudspeaker the force on the moving system is, as known, proportional to applied voltage on the voice coil and to the so-called force factor, and inversely proportional to the impedance of the voice coil. The force factor is the effective product of the coil wire length and the flux density in the air gap of the magnet system. As the voice coil moves in the air gap, magnetic damping arises as a result of counter-induced current in the voice coil. The magnetic damping is also a function of the force factor which is in turn a function of the position of the coil in the magnetic field. Thus, the driving force as well as the magnetic damping are quantities which are dependent on the excursion of the moving system, and this is also the case with the stiffness of the suspension of the moving system.

Therefore, at higher power levels there often occurs a substantial low frequency transient distortion, especially as a result of the reduced magnetic damping at large excursions. Bass reflex systems are especially exposed to such distortion because of the large delayed voice coil or cone excursions when pulses are applied.

From U.S. Pat. No. 3,193,627 there is known a loudspeaker device wherein additional damping is achieved by winding the voice coil on a coil form on an electrically conducting material. However, the achieved effect is excursion independent and the device is thus subject to the above mentioned drawback with reduced magnetic damping at large excursions. Further, from German publication print (DOS) No. 2,134,287 there is known a dynamical loudspeaker having an additional coil with a frequency dependent shortcircuiting. The function of this additional coil is to modify the frequency response of the loudspeaker and it does not contribute to removing said drawback.

The object of the invention is to provide an arrangement which reduces said distortion in that the magnetic damping is increased at large excursions.

For the achievement of the above mentioned object there is provided an arrangement in an electrodynamical loudspeaker of the type set forth above, which arrangement is characterized in that a short-circuit ring is arranged at at least one end of the voice coil.

In accordance with advantageous embodiments of the invention the or each short-circuit ring may consist of a ring of copper wire which is soldered or welded together at the adjacent ends, or it may e.g. consist of a solid aluminium ring. When the voice coil is wound on a tubular voice coil of an electrically conductive material, the short-circuit ring may further be formed integrally with the voice coil form.

Another advantageous embodiment of the invention, which is simple and unexpensive to manufacture, is characterized in that the short-circuit ring is constituted by a coil comprising a number of turns of electrically conducting material and with short-circuited end points. Such a "short-circuit coil" has the advantage that it may be formed of ordinary flexible winding wire of a conductive material, and that the shortcircuiting may be carried out by soldering together the wire ends or by joining the ends in another manner, without the accurate manufacture and matching which is necessary by the use of a solid ring. A particularly simple embodiment of the device according to the invention is provided when the short-circuit ring is constituted by a number of short-circuited turns of the voice coil at an end thereof.

The invention will be more closely described below in connection with a number of exemplary embodiments with reference to the accompanying drawings, wherein FIG. 1 shows a schematic sectional view of one half of an electrodynamical loudspeaker with a device according to the invention;

FIG. 2 shows an electro-mechanical analogy network of an electrodynamical loudspeaker in cabinet;

FIGS. 3 and 4 are diagrams showing respectively flux density distribution in the air gap of the magnet system and the force factor as a function of the position of the voice coil in the magnetic field;

Figure 5:
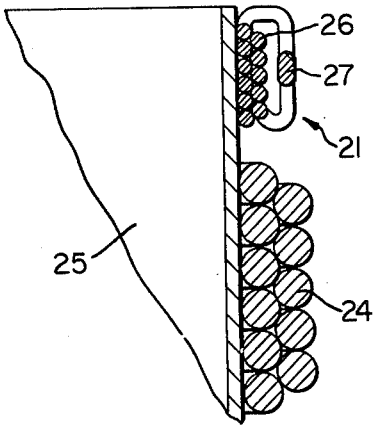
FIG. 5 shows a short-circuit coil with soldered-together wire ends.

In the exemplary embodiment in FIG. 1 there is schematically shown one half of a loudspeaker comprising a frusto-conical loudspeaker basket 1 to the bottom of which there is attached a permanent magnet unit consisting of an annular or ring-shaped magnet 2 to the ends of which there are fixed, e.g. by glueing a top plate 3 and a bottom plate 4 which are both of a suitable steel alloy. In the bottom plate 4 there is provided a central aperture wherein a plug on a pole piece 5 is introduced and fixed. The pole piece 5 has a cylindrical form so that an annular air gap is formed between the top plate 3 and the pole piece, and one end of a tubular, in this case cylindrical, voice coil form 6 projects into said air gap. The outer end of the voice coil form is fixed to a frusto-conical diaphragm or cone 7 which is resiliently suspended in the loudspeaker basket 1. The suspension comprises a flexible, annular centering disk 8 which is fixed to the diaphragm 7 at its inner edge, and is fixed to the loudspeaker basket with its outer edge.

Further, the diaphragm is attached to the loudspeaker basket at its outer end, e.g. through a flexible body 9 or by an extension of the diaphragm cone. By means of said suspension the voice coil form is adapted to move back and forth in the air gap in the direction of the arrow X. As further shown, the diaphragm is at its inner end covered by a dustcover 10.

On the outside of the voice coil form 6, at the lower part thereof according to the orientation in FIG. 1, there is placed a voice coil or moving coil 11 comprising a suitable number of turns. In the shown embodiment a short-circuit ring 12 and 13, respectively, is arranged at each end of the voice coil, the function of said rings being to increase the magnetic damping at large excursions of the voice coil. The short-circuit rings are formed of a material with good electrical conductivity and may e.g. consist of a ring of copper wire which is soldered together at the adjacent ends and e.g. glued to the voice coil form. As an alternative the short-circuit rings may be milled aluminium rings which may also be fixed to the coil form by glueing. The voice coil form is suitably made of aluminium, and the short-circuit rings may then be formed integrally with the coil form. When either of the short-circuit rings by the movement of the voice coil is moved more or less inwards towards the magnetic field in the air gap, said rings cause a substantial, increased magnetic damping.

In the shown embodiment a short-circuit ring is arranged at each end of the voice coil. However, it may also be appropriate to use a short-circuit ring only at one end of the coil. The short-circuit rings may be disposed close to or at a distance from the ends of the voice coil.

With respect to the connection wires for the voice coil 11, these are in a usual manner (not shown) taken out along the coil form and passed through a suitably disposed hole in the diaphragm, and are connected to terminals on the loudspeaker basket. Suitable lead-in holes for the wires may then be provided in the upper short-circuit ring.

Figure 6:
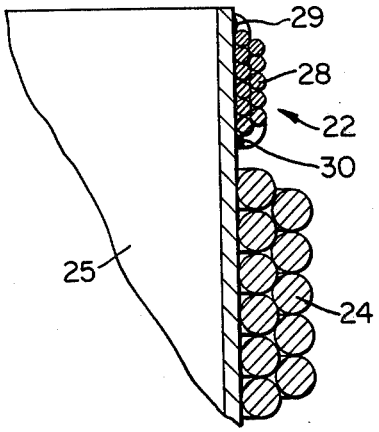
FIG. 6 shows a short-circuit coil wherein the wire ends are connected to a conductive voice coil form.
Figure 7:
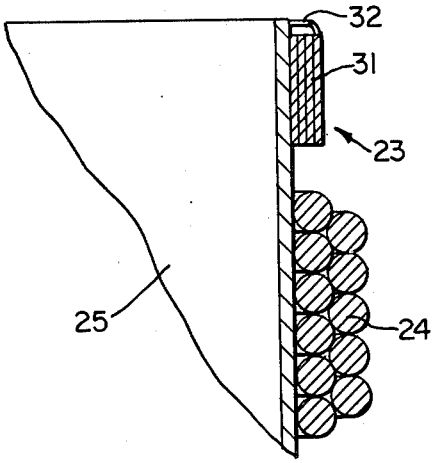
FIG. 7 shows a short-circuit coil consisting of a flat, layer-wound strip.

In FIGS. 5–7 there are shown examples of embodiments wherein the short-circuit ring is constituted by a coil having short-circuited winding end points. In these Figures the short-circuit coils are designated with 21, 22, and 23, respectively. In all three Figures the voice coil is designated with 24 and the voice coil form is designated with 25. In the embodiment according to FIG. 5 the short-circuit coil 21 consists of a relatively thin wire 26 wherein the ends of the winding is soldered together at 27. A possible transition resistance in the joint then becomes relatively small in relation to the total resistance of the coil.

In the embodiment according to FIG. 6, the coil also consists of a relatively thin wire 28, but here a short-circuiting is provided in that the wire ends, e.g. by soldering, are conected to the voice coil form 25 at 29 and 30. In this case the voice coil form consists of electrically conductive material.

The short-circuit coil may also be made of thin-rolled, rectangular layers 31 of conductive material such as shown in FIG. 7. The end of the outermost layer is here connected to the conductive voice coil form 25 by a soldering connection 32. Incidental or intentional mutual short-circuiting between the different layers will not change the effect of the short-circuit coil.

As mentioned before, the short-circuit coil or coils may also be formed in a simple manner by short-circuiting a number of the turns of the voice coil at one or both ends thereof. Starting from e.g. a two-layer wound voice coil, a short-circuit coil may then be formed in that the insulation on the turns of the outer layer is scraped away a distance inwards (e.g. 2–3 mm) from the coil end in question, and the turns are soldered together or joined in another way on the place where the insulation is removed. Thus, in this embodiment the short-circuit coil will be electrically connected to the voice coil itself, even if it may also be separated from the voice coil, such as in the embodiment according to FIGS. 5–7.

In the following the effect of the device according to the invention will be illustrated by means of a pair of calculation examples. Reference being made to the electromechanical analog network in FIG. 2, the following analogies apply:

| | | |
|---|---|---|
| $R_1$ | is analogous to | mechanical resistance because of magnetic damping |
| $L_1$ | is analogous to | the mass of the moving system |
| $C_1$ | is analogous to | the reciprocal of the stiffness (compliance) of the suspension |
| $R_2$ | is analogous to | mechanical resistance in the suspension |
| $C_2$ | is analogous to | the air compliance in the enclosed volume of the cabinet |
| $R_3$ | is analogous to | mechanical resistance in the enclosed volume (absorption) |
| $Z_4$ | is analogous to | leakage or possible port in the cabinet |
| F | is analogous to | the force acting on the moving system |

The mechanical resistance because of magnetic damping is given by $$R_1=(B1)^2/R \text{ Ns/m},$$

wherein B1 is the aforementioned force factor and R is the resistance of the voice coil. Usually one has $R_1 >> R_2 + R_3$. Further, the force F is given by $$F=e.B1/R$$

wherein e is the applied voltage.

As mentioned before, the force factor B1 is a function of the position of the voice coil in the magnetic field in the air gap. In FIGS. 3 and 4 there are shown representative examples of distribution of the flux density B (in $Wb/m^2$) and variation of the force factor B1 (in Wb/m) as a function of the coil excursion in the air gap.

EXAMPLE 1

A short-circuit ring of copper and with a diameter of 0.9 mm was placed at each end of a voice coil having a length of 14 mm and a diameter of 39 mm. The height of the air gap (in the x-direction) was 6 mm. The length of the short-circuit rings was 1=0.12 m and the resistance $R=0.00324$ ohms. The additional resistance is then $(B1)^2/R$ wherein B is the flux density in the actual ring position. The results are set forth in the following table:

| Position (mm) | Mechanical resistance without rings (Ns/m) | Additional resistance from the rings (Ns/m) | Total mechanical resistance (Ns/m) |
|---|---|---|---|
| 0 | 22,4 | 0,2 | 22,6 |
| ±2 | 20,1 | 0,3 | 20,4 |
| ±4 | 16,7 | 0,6 | 17,3 |
| ±6 | 12,0 | 2,5 | 14,5 |
| ±8 | 6,0 | 2,6 | 8,6 |
| ±10 | 2,2 | 1,9 | 4,1 |

EXAMPLE 2

Short-circuit rings of aluminium and with a cross-section of 2 mm ×0.7 mm as in a 8" woofer were placed on an aluminium coil form at each end of a voice coil having a length of 12 mm and a diameter of 39 mm. The air gap height was 6 mm.

With the above values the ring resistance becomes R=0.0024 ohms and the mechanical resistance because of magnetic damping from the ring is $(B1)^{2/R}=6.2B^2$. The mechanical resistance (Ns/m) as a function of coil position can then be summed up in the following table:

| Position mm | Mechanical resistance from the voice coil | 2) Mechanical resistance from the coil form | Sum 1)+2) | 3) 3) Mechanical resistance from the rings | Sum 1)+2)+3) |
|---|---|---|---|---|---|
| 0 | 9,1 | 1,0 | 10,1 | 0,1 | 10,2 |
| ±2 | 8,6 | 1,0 | 9,6 | 0,25 | 9,9 |
| ±4 | 6,2 | 1,0 | 7,2 | 3,0 | 10,2 |
| ±6 | 3,2 | 1,0 | 4,2 | 5,0 | 9,2 |
| ±8 | 1,1 | 1,0 | 2,1 | 5,0 | 7,1 |
| ±10 | 0,2 | 1,0 | 1,2 | 5,0 | 6,2 |

It will be seen that column 4 in the above table (Sum (1)+(2)) sets forth the total mechanical resistance for a conventional loudspeaker, whereas column 6 (Sum (1)+(2)+(3)) sets forth the total mechanical resistance for a loudspeaker which is provided with the device according to the invention. From the above it appears that by means of the invention one achieves an additional resistance because of magnetic damping which has a substantial favourable influence on the transient response, especially in bass reflex systems, so that a reduction of the low frequency transient distortion is achieved.

Finally it will be shown that a short-circuit coil according to the above described embodiments gives the same effect as a short-circuit ring in the form of a solid body. It is then started from a ring with length 1 and cross-sectional area A, and being of a material having a specific conductivity $\sigma$. As stated above, the equivalent mechanical resistance $R_1$ is given by $$R_1 = B^2 l^2 / R$$

wherein B is the flux density in the air gap of the permanent magnet and R is the ohmic resistance of the voice coil. The conductivity being designated with S, one obtains $$R_1 = B^2 l^2 S = B^2 l^2 (A \cdot \sigma / l) = B^2 l A \sigma$$

If the short-circuit ring is assumed to be divided into a short-circuited coil having n serially connected windings or turns, the wire area will be A/n and the total wire length becomes l·n, so that the equivalent mechanical resistance becomes $$R_1 = B^2 \cdot (l \cdot n) \cdot (A/n) \cdot \sigma = B^2 l A \sigma$$

i.e. the same as for the solid ring. Therefore, the solid ring may be splitted up into several serially connected rings without any change of the intended effect.

What I claim is:

1. An electrodynamical loudspeaker comprising:

a voice coil;

a diaphragm to which said voice coil is fixed, a magnet system having an air gap in which said voice coil is resiliently suspended for oscillatory movement to either side from a neutral position, and a short-circuit ring at least one end of said voice coil, wherein said short-circuit ring is disposed in such a position relative to a central portion of said voice coil that it is located outside the air gap of said magnet system when said voice coil is in its neutral position.

2. An electrodynamical loudspeaker according to claim 1 wherein said short circuit ring consists of a wire of copper or other conductive material of which the adjacent ends are joined together.

3. An electrodynamical loudspeaker according to claim 1, wherein said short-circuit ring consists of a solid ring of aluminium or other electrically conductive material.

4. An electrodynamical loudspeaker according to claim 1, wherein said short-circuit ring is constituted by a coil comprising a number of turns of electrically conductive material and with short-circuited end points.

5. An electrodynamical loudspeaker according to claim 1, wherein said short-circuit ring is constituted by a number of short-circuited turns on said voice coil at an end thereof.

* * * * *